US006411035B1

(12) United States Patent
Marcotte

(10) Patent No.: US 6,411,035 B1
(45) Date of Patent: Jun. 25, 2002

(54) AC PLASMA DISPLAY WITH APERTURED ELECTRODE PATTERNS

(76) Inventor: Robert G. Marcotte, 34 Laura Dr., New Paltz, NY (US) 12561

( * ) Notice: Subject to any disclaimer, the term of this patent is extended or adjusted under 35 U.S.C. 154(b) by 0 days.

(21) Appl. No.: 09/401,174

(22) Filed: Sep. 22, 1999

Related U.S. Application Data

(63) Continuation-in-part of application No. 09/310,710, filed on May 12, 1999.

(51) Int. Cl.[7] ..... H01J 17/49

(52) U.S. Cl. ..... 313/585; 345/67; 345/68; 313/583

(58) Field of Search ..... 313/582, 583, 313/584, 585, 586; 315/169.1, 169.3, 169.4; 345/55, 67, 68

(56) References Cited

U.S. PATENT DOCUMENTS

| | | | | |
|---|---|---|---|---|
| 3,666,981 A | | 5/1972 | Lay | 313/584 |
| 4,518,894 A | | 5/1985 | Andreadakis | 313/491 |
| 4,728,864 A | | 3/1988 | Dick | 315/169.3 |
| 5,640,068 A | | 6/1997 | Amemiya | 313/582 |
| 5,852,347 A | | 12/1998 | Marcotte | 313/582 |
| 5,982,344 A | | 11/1999 | Tokunaga | 345/67 |
| 5,998,935 A | | 12/1999 | Marcotte | 313/582 |
| 6,002,381 A | | 12/1999 | Tomio et al. | 345/67 |
| 6,118,214 A | * | 9/2000 | Marcotte | 313/582 |

FOREIGN PATENT DOCUMENTS

| | | | |
|---|---|---|---|
| DE | 19 57132 | 7/1970 | |
| EP | 802 556 | 10/1997 | H01J/17/49 |
| JP | 03 187 125 | 8/1991 | H01J/11/00 |

OTHER PUBLICATIONS

Proc. of Int'l Display Workshop, 1998, pp. 575–578, D. I. Kim et al., "New AC–PDP Structure with Floating Electrodes".

* cited by examiner

*Primary Examiner*—Nimeshkumar D. Patel
*Assistant Examiner*—Thelma Sheree Clove
(74) *Attorney, Agent, or Firm*—Ohlandt, Greeley, Ruggiero & Perle, L.L.P.

(57) ABSTRACT

An AC plasma display panel (PDP) incorporating the invention includes opposed substrates with an enclosed dischargeable gas positioned therebetween; plural elongated address electrodes positioned on one substrate; and plural scan electrode structures positioned on a second opposed substrate and orthogonally oriented to the address electrodes. A plurality of sustain electrode structures are positioned in parallel configuration and interdigitated with the scan electrode structures. Each sustain electrode structure and scan electrode structure is configured as an elongated conductive layer with plural apertures positioned therein. The elongated conductive layer for each sustain electrode structure and each scan electrode structure may be a cross-hatched conductor pattern or a plurality of parallel conductors connected by shorting bars. Moiré effects of the shorting bars are negated by widely spacing the bars and minimizing their length within a pixel site.

8 Claims, 5 Drawing Sheets

AC PLASMA DISPLAY WITH APERTURED ELECTRODE PATTERNS

This Application is a Continuation-in Part of U.S. patent application Ser. No. 09/310,710, filed May 12, 1999.

FIELD OF THE INVENTION

This invention is related to the electrode design of large area plasma display panels (PDPs) and, more particularly, to the use in PDPs of apertured electrodes with sparsely placed shorting bars to eliminate Moire effects and improve operating voltage uniformity.

BACKGROUND OF THE INVENTION

Color plasma display panels (PDPs) are well known in the art. FIG. 1 illustrates a first prior art embodiment of an AC color PDP wherein narrow electrodes are employed on the front panel. More particularly, the AC PDP of FIG. 1 includes a front plate with horizontal plural sustain electrodes 10 that are coupled to a sustain bus 12. A plurality of scan electrodes 14 are juxtaposed to sustain electrodes 10, and both electrode sets are covered by a dielectric layer (not shown). A back plate supports vertical barrier ribs 16 and plural vertical column conductors 18 (shown in phantom). The individual column conductors are covered with red, green or blue phosphors, as the case may be, to enable a full color display to be achieved. The front and rear plates are sealed together and the space therebetween is filled with a dischargeable gas.

Pixels are defined by the intersections of (i) an electrode pair comprising a sustain electrode 10 and a juxtaposed scan electrode 14 on the front plate and (ii) three back plate column electrodes 18 for red, green and blue, respectively. Subpixels correspond to individual red, green and blue column electrodes that intersect with the front plate electrode pair.

Subpixels are addressed by applying a combination of pulses to both the front sustain electrodes 10 and scan electrodes 14 and one or more selected column electrodes 18. Each addressed subpixel is then discharged continuously (i.e., sustained) by applying pulses only to the front plate electrode pair. A PDP utilizing a similar front plate electrode structure is shown in U.S. Pat. No. 4,728,864 to Dick.

Operating voltages and power are controlled by the discharge gap and electrode width. The sustain and scan electrodes are placed to produce a narrow discharge gap and a wide inter-pixel gap. The discharge gap forms the center of the discharge site, and the discharge spreads out vertically. The inter-pixel gap must be made sufficiently large to prevent the spreading plasma discharge from corrupting the ON or OFF state of adjacent subpixels. The width of the electrode and the dielectric glass thickness over the electrode determine the pixel's discharge capacitance which further controls the discharge power and therefore brightness. For a given discharge power/brightness, the number of discharges is chosen to meet the overall brightness requirement for the panel.

As display areas have increased, different methods have been employed to increase the pixel size. FIG. 2 illustrates an electrode structure which employs dual discharge sites per pixel and is the subject of U.S. patent application Ser. No. 08/939,251, to Applicant hereof and assigned to the same Assignee as this Application. Separate discharge sites (e.g., 20, 22) form between each pair of common scan electrodes (e.g., 24 and 26), and an address electrode 28. The discharges then spread across discharge gap C towards opposite sustain electrode loops (e.g., 30 and 32). Light output from each discharge site is emitted at discharge gap C and above and below the electrodes that form each discharge gap. With this electrode arrangement, there is a trade-off between electrode width and brightness because the electrodes tend to shade the emitted light.

FIG. 3 utilizes a wide transparent electrode to achieve both increased pixel capacitance and light output. Wide, transparent electrodes 40 are connected to sustain feed electrodes 10 and scan feed electrodes 42, 44, respectively. The discharge gap C between adjacent transparent electrodes 40 defines the electrical breakdown characteristic for the PDP. The width of electrodes 40 affects the pixel capacitance and, therefore, the discharge power requirements.

The light produced by a transparent electrode pair begins at the discharge gap and spreads out in both directions to and under the feed electrode 44. Since feed electrodes 10, 42 and 44 are at the edges of transparent electrodes 40, they tend to shade the light between pixel sites, producing dark horizontal lines between pixel rows. The wider transparent electrodes 40 provide a means to input greater power levels to the PDP for increased brightness. However, the manufacturing cost of transparent electrodes 40 is high due to the increased number of required processing steps.

The advantages provided by transparent electrodes are a high discharge capacitance and a large pixel area. The dual discharge site topology has low capacitance and therefore requires a greater number of discharge cycles to produce an equivalent amount of light as does the transparent electrode topology. Further, the light produced is concentrated to a very intense area at each discharge site, with additional light emitted between discharge sites. The transparent electrode topology thus produces a larger, brighter and more uniform discharge area than the dual discharge site topology, at the expense of cost.

It is an object of this invention to provide a PDP that exhibits enhanced light output.

It is another object of this invention to provide an improved PDP wherein light output characteristics of transparent electrode structures are achieved without incurring the higher manufacturing costs thereof.

It is a further object of this invention to provide an improved PDP that exhibits improved luminous efficiency.

SUMMARY OF THE INVENTION

An AC plasma display panel (PDP) incorporating the invention includes opposed substrates with an enclosed dischargeable gas positioned therebetween; plural elongated address electrodes positioned on one substrate; and plural scan electrode structures positioned on a second opposed substrate and orthogonally oriented to the address electrodes. A plurality of sustain electrode structures are positioned in parallel configuration and interdigitated with the scan electrode structures. Each sustain electrode structure and scan electrode structure is configured as an elongated conductive layer with plural apertures positioned therein. The elongated conductive layer, for each sustain electrode structure and each scan electrode structure, may be a cross-hatched conductor pattern or a plurality of parallel conductors connected by shorting bars.

DETAILED DESCRIPTION OF THE INVENTION

Figure 4:
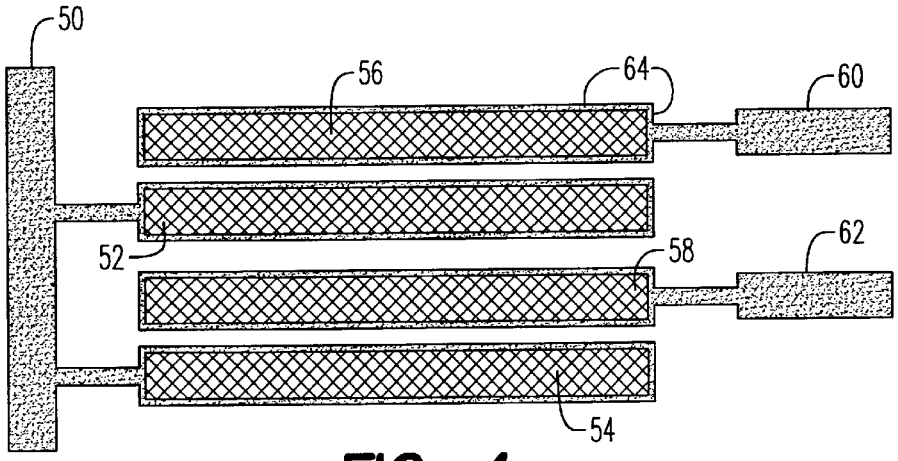
FIG. 4 is a schematic diagram illustrating apertured sustain and scan electrodes (in a cross-hatched pattern) in accord with the invention hereof.

Referring now to FIG. 4, each of the sustain and scan electrodes has been configured as an apertured conductor trace. More particularly, a sustain bus 50 is connected to each of sustain electrodes 52 and 54, while scan electrodes 56 and 58 are connected to scan contacts 60 and 62. Each of the sustain and scan electrodes exhibits a crosshatched conductor pattern. The intervening apertures allow light to escape during discharge actions. The border conductors which enclose the crosshatched conductor patterns (e.g., border conductors 64) provide a uniform boundary for the discharge gap and ensure a uniform discharge voltage between adjacent electrode structures.

By using wide metal electrodes with open areas to allow light to pass through, the pixel capacitance is increased. Further, the electrodes are made sufficiently wide to discharge over a large phosphor area, thus exhibiting an improved luminous efficiency as a result of wider discharge gap dimensions. The apertured electrodes are made through application of a photo-lithographic process to a metalized glass plate. Accordingly, the electrodes making up the crosshatched pattern may be made sufficiently narrow to allow the light to pass between the lines, while preserving the low resistance nature of the overall electrode. Care must be taken in selecting the line widths and spacing to minimize moiré effects (brightness irregularities caused by pattern variations). This crosshatched pattern provides a very uniform capacitance across the electrode width, enabling the brightness across the width to be uniform.

The crosshatched pattern does exhibit a common drawback in common with its transparent predecessor, in that setup voltage waveforms used to establish starting wall potentials will tend to produce added background light due to the larger discharge capacitances. Further, unless care is taken in the spacing of adjacent pixel sites, large discharges may spread out vertically and corrupt adjacent cells.

Figure 5:
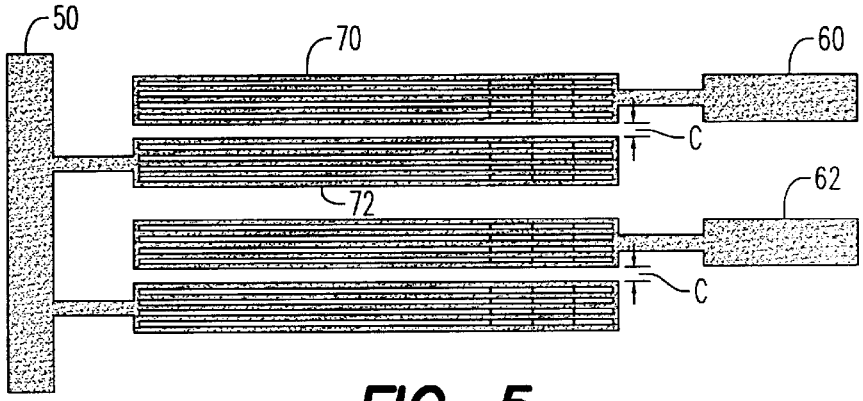
FIG. 5 is a schematic diagram illustrating apertured sustain and scan electrodes (using a parallel conductor pattern) in accord with the invention hereof.

Moiré effects can be reduced using the parallel electrode pattern shown in FIG. 5. Adjacent scan and sustain electrodes 70 and 72, respectively, utilize parallel conductors to produce large pixel sites. Orthogonal shorting bars are positioned at the opposed ends of the parallel conductors and at intermediate positions therebetween. Thus, an open circuit in one parallel conductor will not necessarily render the electrode inoperative due to the bridging effect of adjoining shorting bars. The vertical shorting bars should preferably be narrow and widely spaced to minimize moiré effects. The number of conductors, width, and spacing therebetween allows ample flexibility to control pixel capacitance when using such an electrode topology. Further, by making the pitch distance between the shorting bars the same as the average of the pitch distances of the barrier ribs between subpixels, a high frequency Moiré effect can be substantially reduced.

The electrode pattern of FIG. 5 exhibits advantages over both the transparent and cross-hatched patterns. Namely, the setup discharges principally operate close to the discharge gap C and therefore only discharge a small portion of the total capacitance. This produces less background light and since the setup does not distribute charge evenly across the electrode structure, the address discharge is localized to the discharge gap C and reduces the over-spreading of the plasma.

Figure 6:
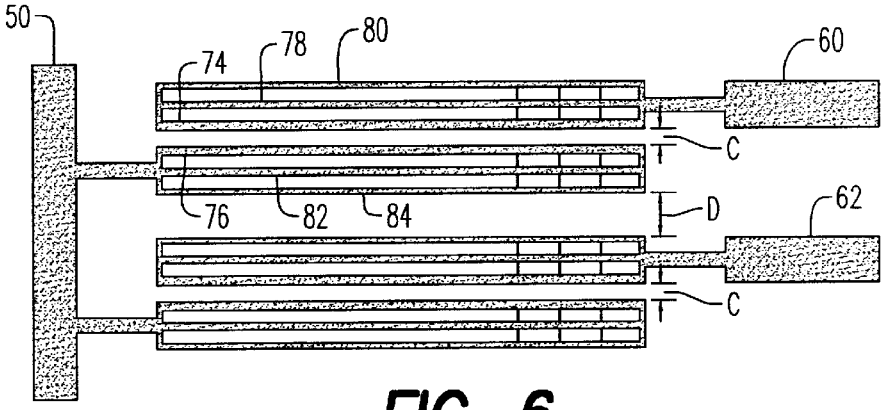
FIG. 6 is a schematic diagram illustrating apertured sustain and scan electrodes as shown in FIG. 5, wherein the parallel conductors have different surface areas.

The electrode pattern of FIG. 6 also uses parallel conductors, however the conductor line widths are varied to increase the capacitance at each discharge gap C. Accordingly, conductors 74 and 76 are widest and conductors 78, 80 and 82, 84 have increasingly lesser widths, respectively. This structure provides improved operating margins and reduces the capacitance of inter-pixel gaps D, thereby reducing plasma spreading.

Figure 7:
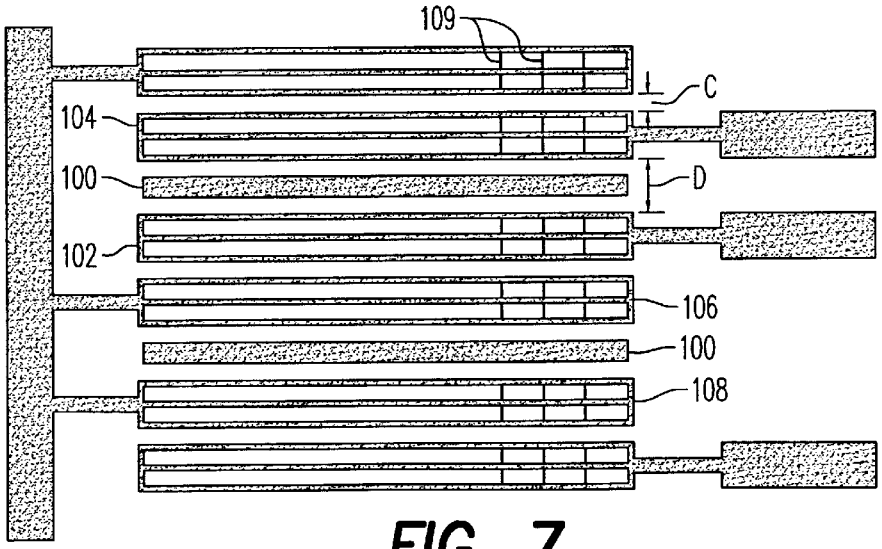
FIG. 7 is a schematic diagram of the invention wherein pairs of apertured sustain and scan electrodes are interdigitated, with adjacent scan electrodes separated by electrically isolated conductor bars.

FIG. 7 shows a further embodiment of the invention wherein dual scan and sustain electrode structures are interdigitated with each other. Further, an electrically floating isolation bar 100 is positioned between adjacent scan electrodes and sustain electrodes, respectively, e.g., between scan electrodes 102, 104 and between sustain electrodes 106 and 108.

As is known, each plasma discharge is comprised of a negative glow region and a positive column region that is attracted to a source of positive charge (i.e., the positive column carries a net negative charge). It has been determined that isolation bars 100 accrue a negative charge during operation of a plasma panel. (See U.S. Pat. No. 3,666,981 to F. Lay). Accordingly, the positioning of isolation bars 100, as shown in FIG. 7 inhibits the positive column from spreading across distance D to an adjacent pixel cell site when a pixel cell discharges across a discharge gap C.

In the embodiment of FIG. 7 vertical shorting bars, 109 span the width of each apertured electrode in both the sustain and scan electrode structures. The placement of those bars must be at the same pitch or longer than the back plate barrier ribs to prevent high frequency Moiré effects. While eliminating the high frequency effects, a low frequency effect still remains visible as a faint rainbow. Depending upon where a shorting bar falls within a color phosphor rib channel, the brightness of the sub-pixel will vary, producing rainbows. When the shorting bars are in the center of the channel between the barrier ribs, the plasma discharge is able to spread across the electrode structure faster and at a lower voltage. This effect diminishes as the shorting bars get closer to or are on top of the barrier ribs. The result is low voltage, high brightness areas when the shorting bar is centered between barrier ribs and high voltage dim areas when the shorting bar is off-center.

When the panel plates are manufactured, and assembled, there are minor variations in the barrier rib pitch and shorting bar pitch due to shrinkage of the plates from high temperature processing. In addition, during assembly there is inherent misalignment in the orthogonality of the two plates. These two effects prevent precise placement of the shorting bars.

As is known, Moiré patterns result from two or more overlaying patterns which are not in 100% alignment. The inclusion of shorting bars within an apertured electrode structure creates a second vertical pattern to existing vertically oriented barrier ribs. The frequency at which these two patterns beat determines the observable light distribution pattern. If the shorting bars are at a pitch much less than the barrier rib pitch, a high frequency moiré pattern will result, depending upon how often the two patterns beat. When the shorting bars are close to the rib pitch or are farther apart, a lower frequency pattern will result. If there are several pixels between the shorting bars, then it is possible to observe narrow lines due to the light intensity variation.

While the use of shorting bars reduces the impact of open electrodes, it is not necessary to have a shorting bar at each discharge site. Therefore, scattering of shorting bars about the plate is possible as a means of reducing pattern disturbance. Similarly, the pattern disturbance brightness can be reduced by minimizing the discharge capacitance of the shorting bars. This can be accomplished by using very narrow line widths, and/or by reducing the length of the shorting bar to only span a portion of an apertured electrode.

Figure 7A:
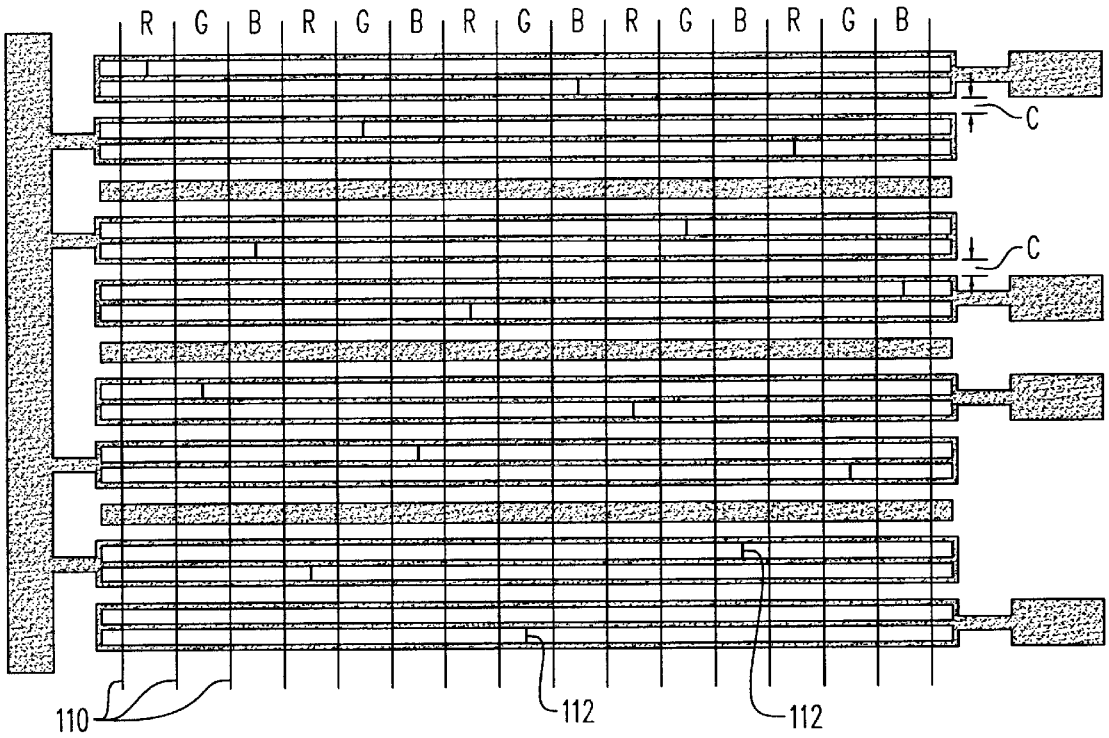
FIG. 7*a* is a schematic diagram of the invention illustrating apertured sustain and scan electrodes with sparsely placed shoring bars.

FIG. 7*a* shows a further embodiment that comprises a subset of the parallel apertured electrode structure of FIG. 7, with the phosphor colors and barrier ribs 110 shown. Shorting bars 112 have been reduced in length to only bridge two of the three electrodes within a scan or sustain electrode and are completely removed from the electrode structure across the discharge gap C. This arrangement reduces the amount of shorting bar metal by a factor of four for each discharge site. A pattern is then selected such that shorting bars 112 are placed at different locations within the electrode structure such that the bridging function is retained.

Shorting bars 112 are then spaced such that, at most, only one shorting bar 112 occurs within any RGB pixel. This assures that, on a per pixel basis, the pattern disturbance is only applied to a single color, thereby reducing the disturbance by another factor of three. In FIG. 7*a*, shorting bars 112 are placed so that they are distributed between the colors to prevent an over-abundance of energy in any one color.

Further pattern disturbance reduction can be accomplished by expanding the pattern such that no shorting bar 112 is placed in any RGB pixel that surrounds each RGB pixel containing a shorting bar 112. Such an arrangement of shorting bars still aids in preventing open electrodes since an open within an electrode structure will continue to be bridged. Since the occurrence of opens is random and they are widely spaced, the shorting bars may be very widely spaced. As a result, there is a tradeoff between pattern disturbance reduction and manufacturability.

The sizable reduction in pattern disturbance, helps to eliminate any visible effects of misalignment or plate shrinkage, and the display operates uniformly at the higher operating voltage seen with the arrangement of FIG. 7, without any major change in the discharge characteristics. In summary, the sparse placement of shorting bars virtually eliminates voltage and brightness variations caused by the shorting bars and greatly reduces Moiré effects.

Figure 8:
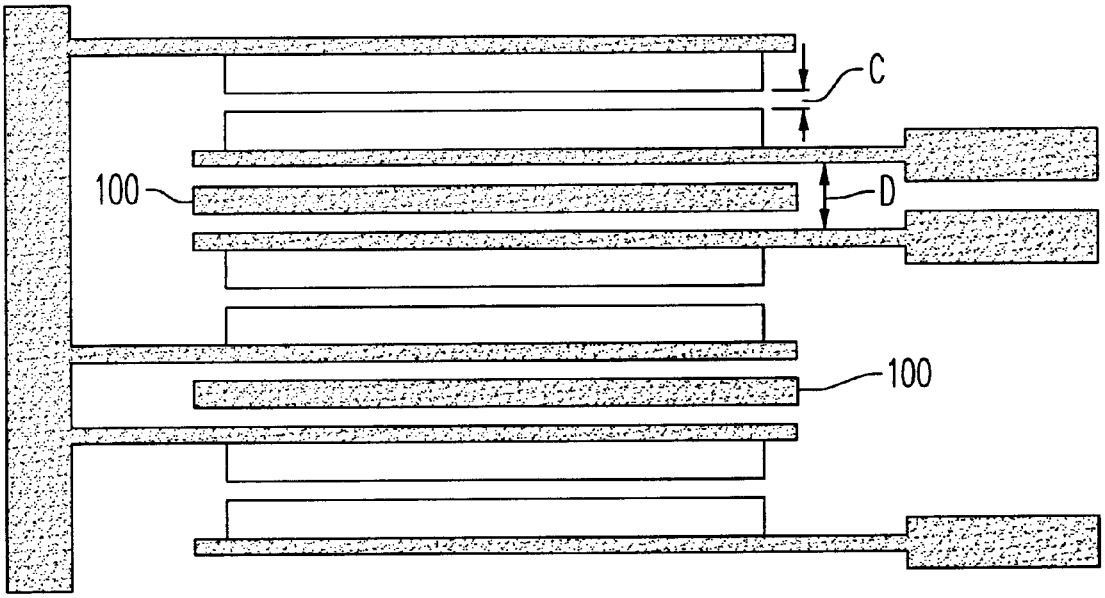
FIG. 8 is a schematic diagram of the invention wherein pairs of transparent sustain and scan electrodes are interdigitated, with adjacent sustain and scan electrodes, respectively, separated by electrically isolated conductor bars.

FIG. 8 illustrates the use of isolation bars 100 between adjacent transparent electrode structures to prevent the spreading of positive column discharge regions to adjacent pixel sites. Each of the scan electrode pairs and sustain electrode pairs are interdigitated as shown in FIG. 7.

As stated above, each plasma discharge is comprised of a negative glow region and a positive column region that is attracted to a source of positive charge. The electrode topologies shown in FIGS. 4–7 successfully spread out the discharge and allow for a much longer positive column discharge region. Each discharge forms at the center of a discharge gap C. As the discharge develops, the negative glow region forms at the cathode electrode closest to the discharge gap. A positive column region quickly develops to span the anode electrode, assisted by the shorting bars. As the discharge continues, the negative glow slowly drifts, much like a wave, from the discharge gap C to the outermost cathode electrode conductor, while current flows through the positive column. As the negative glow drifts across the cathode electrode conductors, the discharge path to the anode electrode is further lengthened, further increasing the length of the positive column.

The luminous efficiency characteristic of such an electrode pattern is quite different from that of the prior art electrode topologies. It is well known in the art that the efficiency declines as applied voltage is increased. This is due primarily to the fact that the discharge is confined to the discharge gap and the additional power provided by the increased voltage is consumed by the negative glow. The patterns of FIGS. 5, 7 and 9 demonstrate higher efficiencies and a flatter efficiency vs. voltage characteristic over the prior art electrode patterns. This is due to the use of widely spaced narrow parallel lines.

At low voltages, the discharge is contained to the immediate discharge gap area and so the wall capacitance at the farthest electrodes is not utilized. As the voltage increases, more of the electrode capacitance is utilized, providing more power to the discharge. This increased power is shared by the higher efficiency positive column instead of the negative glow, achieving a rough balance in overall efficiency.

The flat efficiency characteristic allows for AC PDP's power and brightness to be modulated by the applied sustain voltage. By simply adjusting the sustain voltage, the power and brightness has been found to nearly double within a 20 volt operating span of the display. Thus, the PDP power supply may be controlled to operate at the high end of the operating voltage range to maximize brightness, then to automatically reduce the voltage as the load increases, thereby limiting power. Further, since PDPs break up the light output into binary weighted blocks, called subfields, the brightness of different levels can be controlled by a combination of the number of sustain discharges and the sustain voltage. In this fashion, very dim, low light levels can be achieved using a small number of low voltage discharges, while high brightness levels can be achieved with increased voltages and many discharges.

The dimensions used for the layout of the electrode structures of the invention provide several control variables. As with the prior art, the discharge gap determines minimum discharge voltage. While the electrode structure will function without the shorting bars, they help to maintain a low discharge voltage by providing a discharge path from the discharge gap to the electrode structure conductors. The shorting bars should be narrow so as not to block light or create moiré effects. This topology is easiest to operate when the discharge gap is close to or less than the substrate gap to the back plate.

Figure 1:
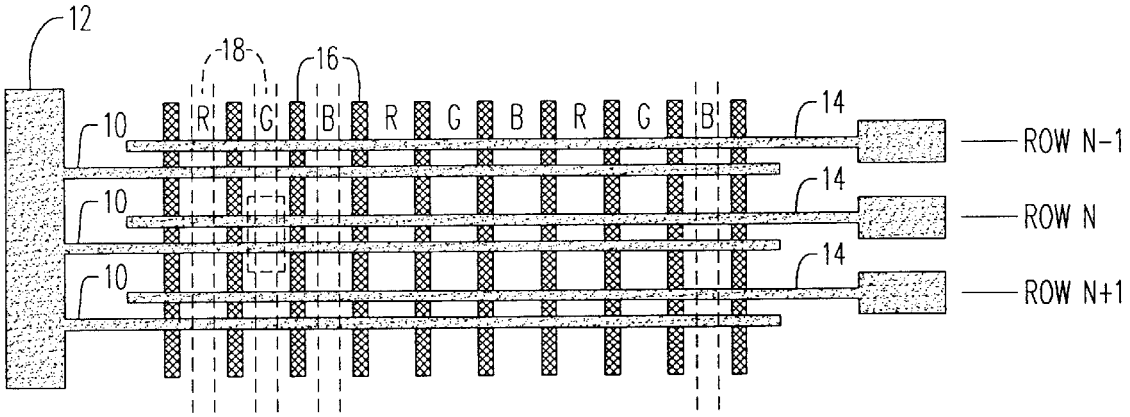
FIG. 1 (PRIOR ART)
FIG. 1 is a schematic diagram of a prior art color PDP using narrow, scan and sustain electrodes.
Figure 2:
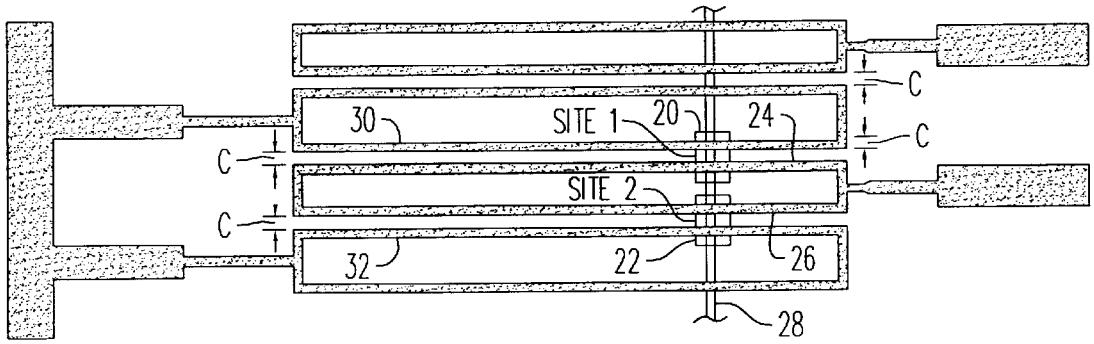
FIG. 2 (PRIOR ART)
FIG. 2 is a schematic diagram of a PDP that incorporates dual discharge sites.

The electrode structure conductor width and spacing determine the wall capacitance and therefore the power of the discharge. When compared to dual discharge site PDPs (as shown in FIG. 2), the electrode structure of FIG. 7 provides nearly the same power level. This is despite a 25% decrease in total electrode width. The length of the overall discharge area traditionally plays a secondary effect in terms of power consumption. The spacing of the conductor lines also plays a role in the power and efficiency, since the negative glow drifts thereacross. The wider the gaps between conductor lines of an electrode structure, the narrower the negative glow region will be. Satisfactory operation has been experienced with conductor line gaps as wide as discharge gap C.

The placement of isolation bars 100 is important as they will tend to repel the positive column region away from the outermost conductor of an electrode structure. A reasonable distance to maintain from an outermost conductor line of an electrode structure to the isolation bar, is a discharge gap C. Likewise, the width of the isolation bar can be set to a discharge gap C. This yields a distance of three discharge gaps between pixel sites and provides a sufficiently large interpixel gap, D, to maintain cell to cell isolation.

The background brightness created by setup discharges in a PDP constructed in accord with the invention, is about half the brightness of the prior art dual discharge site PDPs. This is primarily due to the fact that there is half the number of discharge sites. Setup discharges are used to establish well defined wall voltage states before an addressing operation is applied to a PDP.

During setup voltage ramps, the discharge is contained to the conductor bars on either side of the discharge gap. The next conductor bar (e.g., the center conductor bar) contributes a minor portion of the background glow, and no visible light is seen out at the third conductor. This is in contrast to a PDP with transparent electrodes where the background glow encompasses the entire transparent electrode, discharging the entire capacitance.

Figure 3:
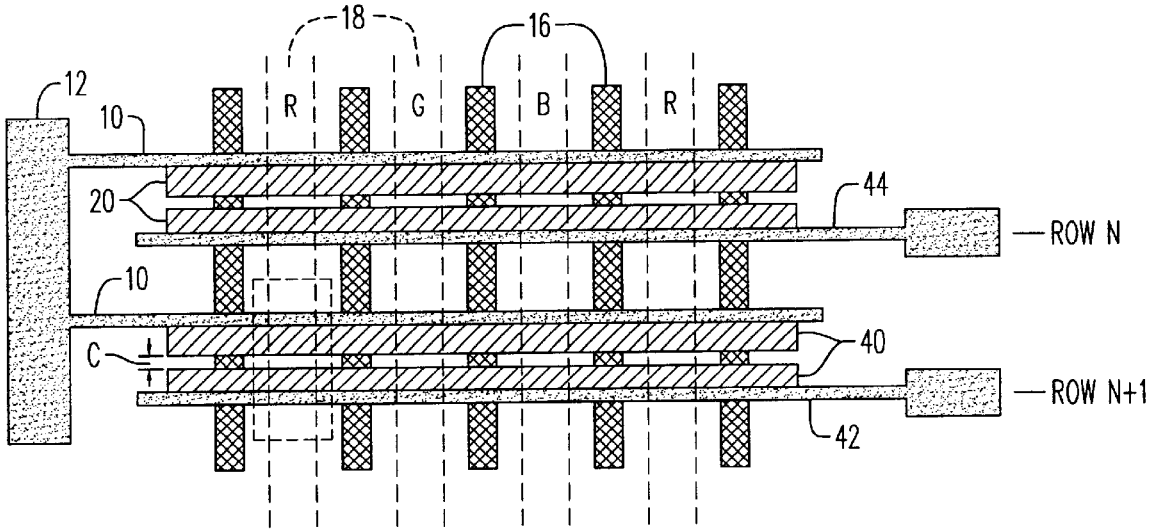
FIG. 3 (PRIOR ART)
FIG. 3 is a schematic diagram of a prior art PDP structure that employs transparent electrodes.

As shown in FIG. 3, it has been common practice in the art to position the transparent electrodes such that scan and sustain electrodes are alternated. Prior art topologies requires a wide interpixel gap for cell to cell isolation primarily because, during addressing, a discharge forms between the back substrate address electrode and the front substrate scan electrode. The address discharge ignition point occurs randomly in the area directly under the wide transparent electrode. As the discharge develops, the positive column generally grows toward and across the discharge gap, however when the ignition point occurs close to the interpixel gap, it is possible for the positive column to grow across the interpixel gap instead of the discharge gap resulting in an addressing failure.

Accordingly, as shown in FIGS. 7 and 8, it is advantageous to pair scan electrodes and sustain electrodes so that the electrical field across the interpixel gap is eliminated. FIG. 7*a* includes this topology.

With the prior art transparent electrode topology, two field regions are created. The primary field is across the discharge gap, while a secondary field is created across the interpixel gap. By pairing the transparent electrodes, as shown in FIG. 8, the primary field remains at the discharge gap, and the secondary field is eliminated since the neighboring electrode is always near the same potential. In addition to improved cell-to-cell isolation, scan to sustain capacitance is reduced almost in half.

Figure 9:
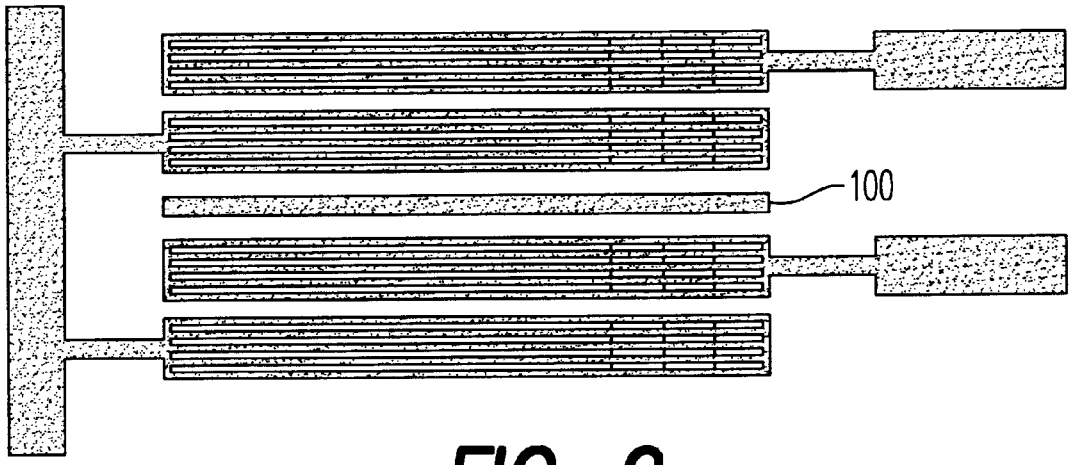
FIG. 9 is a schematic diagram of the invention wherein adjacent apertured sustain and scan electrodes are separated by electrically isolated conductor bars.

FIG. 9 illustrates the application of isolation bars between adjacent sustain and scan electrodes.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An AC plasma display panel (PDP) including opposed substrates with an enclosed dischargeable gas positioned therebetween, comprising:

a) plural elongated address electrodes positioned on one said substrate;

b) plural scan electrode structures positioned on a second said substrate and orthogonally oriented to said address electrodes;

c) plural sustain electrode structures in parallel configuration and interdigitated with said scan electrode structures on said second substrate, wherein, each said sustain electrode structure and each said scan electrode structure comprises an elongated conductive layer having plural apertures positioned therein, wherein the elongated conductive layer for each said sustain electrode structure and each said scan electrode structure comprises a plurality of parallel conductors connected by shorting bars at ends thereof, wherein the parallel conductors for each electrode structure are further connected by additional shorting bars placed between said ends thereof; and d) barrier ribs positioned adjacent each of said elongated address electrodes to isolate adjacent subpixel sites, each of N adjacent subpixel sites comprising a pixel site, wherein said plurality of parallel conductors for each said sustain electrode structure and each said scan electrode structure comprises at least three parallel conductors, and wherein each said additional shorting bar is connected between a subset of said at least three conductors.

2. The AC PDP as recited in claim 1, wherein there is no more than one said additional shorting bar associated with each said pixel site.

3. The AC PDP as recited in claim 1, wherein said additional shorting bars associated with each sustain electrode structure and each scan electrode structure, respectively, are positionally separated by at least N adjacent pixel sites.

4. The AC PDP as recited in claim 1, wherein said additional shorting bars positioned in adjacent sustain electrode structures and scan electrode structures are respectively positioned at different subpixel sites.

5. An AC plasma display panel (PDP) including opposed substrates with an enclosed dischargeable gas positioned therebetween, comprising:

a) plural elongated address electrodes positioned on one said substrate;

b) plural scan electrode structures positioned on a second said substrate and orthogonally oriented to said address electrodes;

c) plural sustain electrode structures in parallel configuration with said scan electrode structures, adjacent pairs of sustain electrode structures interdigitated by pairs of scan electrode structures;

d) a conductive, electrically isolated, bar positioned between each of immediately adjacent scan electrode structures that comprise a pair;

e) a conductive, electrically isolated, bar positioned between each of immediately adjacent sustain electrode structures that comprise a pair, wherein the elongated conductive layer for each said sustain electrode structure and each said scan electrode structure comprises a plurality of parallel conductors connected by shorting bars at ends thereof, wherein the parallel conductors for each electrode structure are further connected by shorting bars placed between said ends thereof; and f) barrier ribs positioned adjacent each of said elongated address electrodes to isolate adjacent subpixel sites, each of N adjacent subpixel sites comprising a pixel site, wherein said plurality of parallel conductors for each said sustain electrode structure and each said scan electrode structure comprises at least three parallel conductors, and wherein each said additional shorting bar is connected between a subset of said at least three conductors.

6. The AC PDP as recited in claim 5, wherein there is no more than one said additional shorting bar associated with each said pixel site.

7. The AC PDP as recited in claim 5, wherein said additional shorting bars associated with each sustain electrode structure and each scan electrode structure, respectively, are positionally separated by at least N adjacent pixel sites.

8. The AC PDP as recited in claim 5, wherein said additional shorting bars positioned in adjacent sustain electrode structures and scan electrode structures are respectively positioned at different subpixel sites.

* * * * *